US007562689B1

(12) United States Patent
Militello et al.

(10) Patent No.: US 7,562,689 B1
(45) Date of Patent: Jul. 21, 2009

(54) CLIP FOR WINDOW COVERING CORD

(75) Inventors: David R. Militello, Rohnert Park, CA (US); Barry L. Shevick, Fair Oaks, CA (US)

(73) Assignee: Shades Unlimited, Inc., Cotati, CA (US)

( * ) Notice: Subject to any disclaimer, the term of this patent is extended or adjusted under 35 U.S.C. 154(b) by 237 days.

(21) Appl. No.: 11/205,944

(22) Filed: Aug. 16, 2005

(51) Int. Cl.
*E06B 3/94* (2006.01)

(52) U.S. Cl. ..... 160/84.04; 160/368.1

(58) Field of Classification Search ..... 160/84.04, 160/84.01, 84.03, 330, 173 V, 84.05, 170, 160/171, 168.1 R, 173 R, 178.1 R, 193; 16/93 D, 84.6 R; 248/227.4, 228.7, 231.81, 248/317, 342
See application file for complete search history.

(56) References Cited

U.S. PATENT DOCUMENTS

| | | | | | |
|---|---|---|---|---|---|
| 870,876 | A | | 11/1907 | Fleming | |
| 1,220,881 | A | | 3/1917 | Nelson | |
| 1,270,634 | A | | 6/1918 | Lowe | |
| 1,830,223 | A | | 11/1931 | Bushnell | |
| 2,307,095 | A | | 1/1943 | Zaferakis | |
| 3,062,381 | A | | 11/1962 | Maiden | |
| 3,142,858 | A | * | 8/1964 | Bieda | 16/87.6 R |
| 3,248,749 | A | * | 5/1966 | Williams | 16/93 D |
| 3,485,285 | A | * | 12/1969 | Anderle | 160/168.1 R |
| 4,271,893 | A | | 6/1981 | McCluskey | |
| 4,328,605 | A | * | 5/1982 | Hutchison et al. | 24/115 G |
| 4,373,569 | A | | 2/1983 | Barettella | |
| 4,597,430 | A | | 7/1986 | Marquez | |
| 4,673,018 | A | * | 6/1987 | Judkins | 160/84.06 |
| 4,836,265 | A | | 6/1989 | Bussert | |
| 4,909,297 | A | * | 3/1990 | Koller et al. | 160/84.01 |
| 5,025,848 | A | | 6/1991 | Prochaska | |
| 5,105,867 | A | | 4/1992 | Coslett | |
| 5,158,127 | A | * | 10/1992 | Schumacher | 160/84.07 |
| 5,279,473 | A | | 1/1994 | Rozon | |
| 5,316,247 | A | * | 5/1994 | Wodka | 248/73 |
| 5,323,514 | A | * | 6/1994 | Masuda et al. | 24/115 G |
| 5,354,011 | A | | 10/1994 | Rozon | |
| 5,485,875 | A | * | 1/1996 | Genova | 160/168.1 R |

(Continued)

FOREIGN PATENT DOCUMENTS

| | | |
|---|---|---|
| DE | 3024712 | 2/1981 |

(Continued)

*Primary Examiner*—Katherine W Mitchell
*Assistant Examiner*—Jaime F Cardenas-Garcia
(74) *Attorney, Agent, or Firm*—Heisler & Associates

(57) ABSTRACT

A clip is provided which acts as a holder for a lift cord or other cord of a window covering. The clip includes a fastener through which the clip is coupled to a lower portion of the window covering, such as a bottom rail of the window covering. The clip also includes a guide path which supports a portion of the cord adjacent to the clip. The clip would typically be coupled to a lower portion of the window covering, such as a bottom rail, at a lateral edge of the bottom rail, so that the cord has a reduced amount of vertical suspension from the bottom rail and is reoriented to a new desired position extending down from the clip on the bottom rail. The guide path can be a partial or complete hole or trough through which the cord is routed.

1 Claim, 4 Drawing Sheets

U.S. PATENT DOCUMENTS 5,676,415 A 10/1997 Ament
5,706,876 A 1/1998 Lysyj
5,762,281 A 6/1998 Foley
5,915,442 A 6/1999 Prosch
5,960,846 A 10/1999 Lysyj
6,024,154 A 2/2000 Wang
6,029,734 A 2/2000 Wang
6,047,759 A 4/2000 Lysyj
6,056,036 A 5/2000 Todd
6,149,094 A 11/2000 Martin
6,283,192 B1 9/2001 Toti
6,289,964 B1 9/2001 Colson
6,289,965 B1 9/2001 Ruggles
6,330,899 B1 12/2001 Ciuca
6,408,492 B1 * 6/2002 Sparks et al. ..... 24/336
6,443,207 B1 * 9/2002 Cheng et al. ..... 160/84.04
6,463,985 B1 * 10/2002 Hsu ..... 160/84.04
6,470,948 B2 10/2002 Yates
6,508,293 B1 1/2003 Huang
6,571,853 B1 6/2003 Ciuca
6,575,223 B1 6/2003 Chung
6,601,635 B2 8/2003 Ciuca
6,637,493 B1 * 10/2003 Lampers ..... 160/178.1 R
6,644,372 B2 11/2003 Judkins
6,644,373 B2 11/2003 Palmer
6,644,375 B2 11/2003 Palmer
6,675,861 B2 1/2004 Palmer
6,681,831 B1 * 1/2004 Cheng et al. ..... 160/84.06
6,761,202 B1 * 7/2004 Cheng et al. ..... 160/170
6,761,203 B1 7/2004 Huang
6,823,925 B2 11/2004 Militello
6,845,801 B2 * 1/2005 Hsu ..... 160/84.04
6,941,996 B2 9/2005 Ward
6,941,998 B2 9/2005 Nien
6,948,545 B1 * 9/2005 Cheng et al. ..... 160/170
6,966,353 B2 * 11/2005 Hsu ..... 160/84.04
6,971,434 B2 * 12/2005 Nien ..... 160/172 R
6,991,020 B1 1/2006 Cheng
7,198,087 B2 * 4/2007 Hsu ..... 160/84.01
7,225,850 B2 * 6/2007 McCarty et al. ..... 160/168.1 R
7,255,149 B2 * 8/2007 Rossato et al. ..... 160/84.04
7,373,965 B2 * 5/2008 Cheng ..... 160/178.2
2002/0033241 A1 3/2002 Palmer
2002/0157796 A1 10/2002 Judkins
2003/0111191 A1 6/2003 Ciuca
2004/0094274 A1 5/2004 Judkins
2004/0154758 A1 8/2004 Cheng
2004/0182522 A1 * 9/2004 Strand et al. ..... 160/84.05
2005/0098274 A1 5/2005 Nien
2005/0189077 A1 9/2005 Nien
2005/0274466 A1 * 12/2005 Hsu ..... 160/168.1 R
2005/0274868 A1 12/2005 McCance
2006/0010782 A1 1/2006 Nien
2006/0054288 A1 3/2006 Bibby
2006/0081341 A1 4/2006 Nien

FOREIGN PATENT DOCUMENTS

GB 2339820 2/2000

* cited by examiner

CLIP FOR WINDOW COVERING CORD

FIELD OF THE INVENTION

The following invention relates to window coverings configured to have different orientations at which different portions of the window are covered, and which include cords dangling downward therefrom at least some of the time. More particularly, this invention relates to clips and other structures for holding cords extending down from a window covering where desired.

BACKGROUND OF THE INVENTION

Window coverings come in many different configurations. Many window coverings are adjustable in various different ways, such as including adjustable height for a lower portion of the shade, such as a bottom rail. Such adjustable shades can be lifted or lowered to cause the shade to alternatively block a greater or lesser portion of the window. Lift cords are provided that can be manipulated to control the position of the bottom of the shade. Other cords are often utilized to adjust an angle at which slats or other structures within the window are oriented. Such cords may extend down from different portions of the shade, depending on the configuration of the shade.

One shade in particular which is adjustable is shown in FIG. 1 and exists within the prior art. This shade includes lift cords which extend from a top rail down through the shade or other window covering to a bottom rail. In the bottom rail they come together and pass through a cord brake which holds the cords in position and holds the bottom rail where desired, except when a button is pushed to allow height adjustment of the bottom rail. This prior art shade depicted in FIG. 1 has the cords extending down from the cord brake in the middle of the bottom rail.

Such a configuration for this particular shade, and perhaps other shades, is not always the most desirable orientation. This orientation causes the cords to block somewhat the view out through the window when the shade is partially or fully raised. In general, it would be more desirable if these cords extended down from one edge of the shade so that the window would not be blocked by the cords in any fashion. Also, having the cords angled over to some form of cord holder off to the side of the shade would decrease a length that the cord would dangle down from the bottom rail. Cords can present danger to children, pets and others, and so are best kept sufficiently high so that children cannot handle them. Also, keeping them sufficiently elevated can reduce the possibility of children being able to play with the shades and potentially damage them.

Accordingly, a need exists for some form of cord management system which can hold cords which would otherwise extend from a portion of the shade which is not desired over to a different portion of the shade where location of the exposed cords is more desirable, and with potentially less of the cords extending downwardly therefrom.

SUMMARY OF THE INVENTION

With this invention, a clip is provided which acts as a cord holder or retainer for a lift cord or other cord (or cords) of a window covering, so that the cord can extend from a different portion of the shade than would otherwise be the case. In particular, the clip in its preferred form is configured to attach to a portion of a bottom rail of a window covering directly above a position where the cords are desired to extend downwardly, and typically near one of the lateral edges of the bottom rail. The clip generally includes two portions including a fastener which is adapted to couple the clip to the bottom rail of the shade and a guide path which is adapted to support a portion of the lift cord extending through the guide path provided by the clip. The fastener for the clip can be provided in various different forms, depending on the particular embodiment of the invention. Such means to couple the clip to a lower portion of the window covering can include clamping surfaces which clamp onto the bottom rail or other portion of the window covering to hold the clip to the bottom rail. Alternatively, the coupling means can be in the form of a surface provided with an adhesive for bonding to the bottom rail or other portion of the window covering, or can include a nose or other structure which acts as an insert sized to slide into and fit snugly within an interior of the bottom rail. Other fasteners could also be provided for coupling the clip to the bottom rail or other portion of the window covering.

The guide path can also be configured in various different ways according to different embodiments of this invention. For instance, the guide path can be formed as a substantially complete hole surrounding a centerline along which the cord is generally routed. Such a substantially complete hole could be in the form of a complete eyelet or a substantially complete hole in the form of spiralet. This guide path can also be configured as a hanger, slot, trough or collar, along which the cord can be routed so that the cord dangles down from the clip after being routed laterally over from a center of the bottom rail where the cords exit the bottom rail, or over from any other location on the shade where the cords are originally provided according to the particular configuration of the window covering with which the clip is utilized.

OBJECTS OF THE INVENTION

Accordingly, a primary object of the present invention is to provide a clip attachable to a portion of a window covering for adjusting a location at which a lift cord extends down from the window covering.

Another object of the present invention is to provide a cord holder which can hold at least a portion of a lift cord of a window shade at a desired position relative to other portions of the window covering.

Another object of the present invention is to provide a retainer for a lift cord which can be attached to a portion of the window covering and have the lift cord routed adjacent thereto for controlling a position of the cord.

Another object of the present invention is to provide a window covering lift cord clip which can attach to a bottom rail of a window shade with lift cords included therewith that originally dangle from an undesired location from the bottom rail, and route the cords through the clip so that they now extend down from a desired location on the bottom rail.

Another object of the present invention is to provide a cord holder which shortens a distance with which a cord dangles down from a bottom rail of a window covering.

Another object of the present invention is to provide a window covering which utilizes lift cords but which maintains a position of the lift cords at a variable location on the shade.

Another object of the present invention is to provide a window covering which utilizes cords for lifting the window covering, but which maintains some degree of child safety by keeping at least a portion of the cords elevated to extend down from a bottom portion of the window covering a relatively short distance.

Another object of the present invention is to provide a retainer for a lift cord of a window covering which allows a cord of a window covering to be routed away from a center portion of the window where the window covering is mounted, to improve a view through the window.

Other further objects of the present invention will become apparent from a careful reading of the included drawing figures, the claims and detailed description of the invention.

DESCRIPTION OF THE PREFERRED EMBODIMENT

Figures 1, 2, 3:
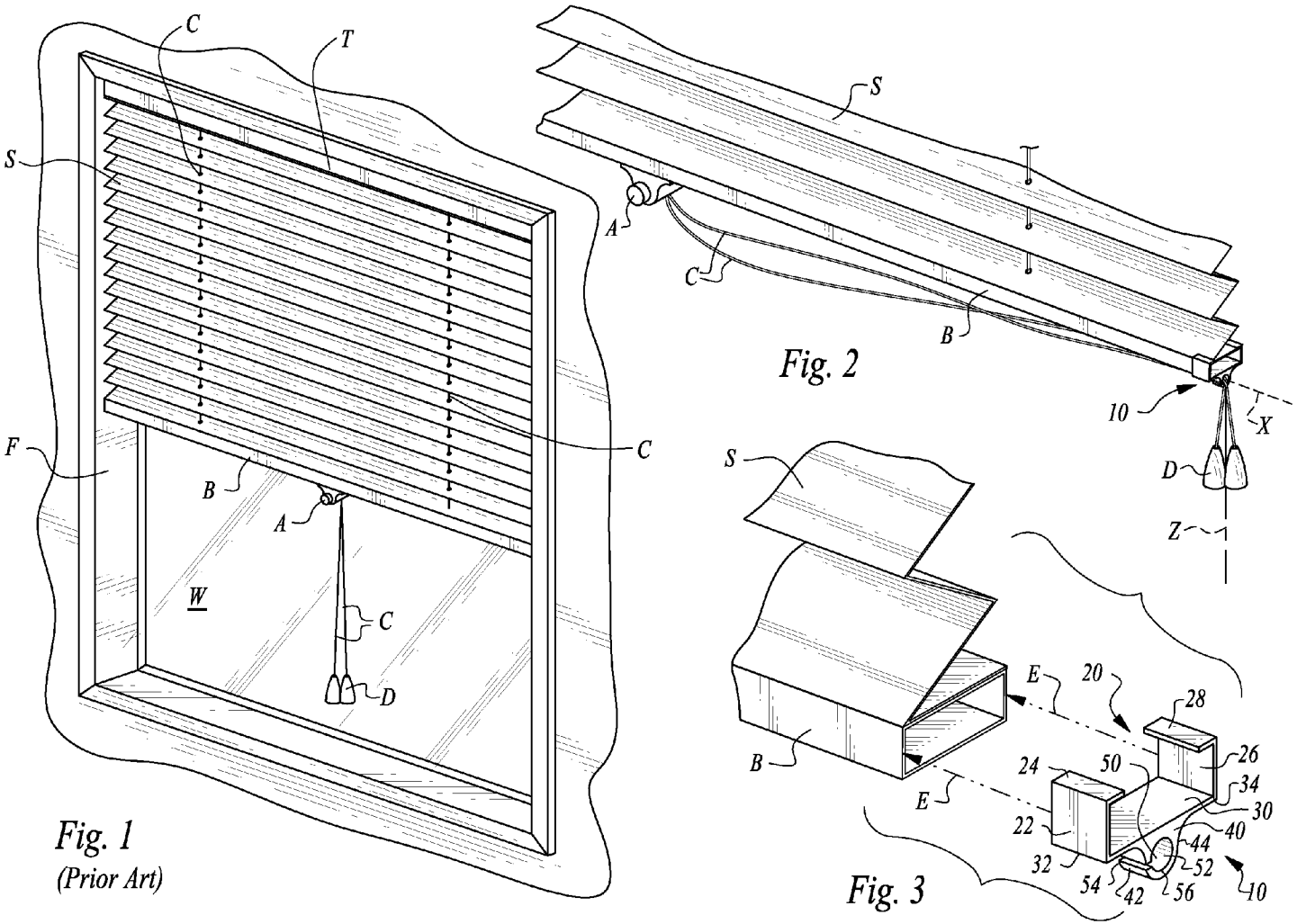
Fig. 1 (Prior Art)
FIG. 1 is a perspective view of a prior art window covering mounted within a window frame adjacent a window and showing how cords extend down from a central portion of a bottom rail of the window covering before utilization of the invention disclosed herein.
FIG. 2 is a perspective view of a portion of that which is shown in FIG. 1, but with the clip of this invention, according to an initial embodiment of this invention.
FIG. 3 is a perspective view of a detail of a portion of that which is shown in FIG. 2 and with the clip of this invention shown exploded away from the bottom rail of the shade, to illustrate how the clip is attached and detached from the bottom rail of the shade.

Referring to the drawings, wherein like reference numerals represent like parts throughout the various drawing figures, reference numeral 10 is directed to a clip which defines an initial embodiment of a holder for a lift cord C or other cord (or cords) of a window covering, such as a shade S (FIG. 2). The clip 10 acts as one form of retainer for the lift cords C so that the lift cords C can extend down from an edge of the shade S or other window covering, rather than from a center thereof. Additionally, the cords C extend a lesser distance down from a bottom rail B or other lower portion of the shade S or other window covering to decrease accessibility of the cords C to children and improve a view through the window W adjacent to which the shade S or other window covering is mounted.

In essence, and with particular reference to FIGS. 2 and 3, basic details of this initial embodiment of the clip 10 are described. The clip 10 generally includes two portions including a form of a fastener which is adapted to couple the clip 10 to a lower portion of the window covering, such as the shade S, and a guide path which is adapted to support a portion of the lift cord C upon the clip 10. In this initial embodiment, the fastener is embodied in a pair of fingers 20 extending up from a base plate 30 of the clip 10. These fingers 20 surround a bottom rail B of the shade S to hold the clip 10 upon the bottom rail B of the shade S. A junction 40 extends down from the base plate 30 and includes an eyelet 50 therein. This eyelet 50 defines one form of the guide path of this invention according to this initial embodiment. The eyelet 50 has the cords C routed therethrough (FIG. 2) so that the cords C extend down from the eyelet 50 of the clip 10, rather than extending down directly from the bottom rail B (FIG. 1).

More specifically, and with particular reference to FIGS. 1 and 2, specific details of the shade S or other window covering of the prior art, which epitomizes the window covering for which the clip 10 and other cord holders of this invention are configured to work upon, is described in detail. While the shade S is shown as a pleated continuous shade, the window covering could alternatively be in the form of a blind with separate slats, or some other form of window covering which utilizes lift cords C which dangle down from some portion of the window covering, and typically from a bottom rail B or other lower portion of the window covering. With this shade S, lift cords C extend down from a top rail T to a bottom rail B. The lift cords C then come together at a cord brake extending down from a central portion of the bottom rail B. This cord brake includes a button A which can be depressed to release the cord brake, or released so that the cord brake engages the cords C. When this button A is depressed, the bottom rail B can be lifted up or lowered down to adjust the degree to which a window W adjacent the shade S is covered by the shade S. The cords C typically extend down to dangles D at ends of the cords C. The window W typically resides within a frame F with the shade S mounted within the frame F.

With the utilization of this invention, the length of cords C extending down from the cord brake is decreased (FIG. 2) with the cords C routed initially generally horizontally along central axis X from the cord brake of the bottom rail to the clip 10 or other cord holder. After passing adjacent the clip 10 or other cord holder, and along the guide path of the clip 10 or other cord holder, the cords C angles downward, generally along dangle axis Z. Most preferably, the clip 10 or other cord holder is located at the end of the bottom rail B so that a maximum amount of the cords C can be routed horizontally. Alternatively, with at least some forms of the cord holder of this invention, the clip 10 or other cord holder can be located at various different positions along the bottom rail B depending on the desires of the user and the function desired for the clip 10 or other cord holder of this invention.

With particular reference to FIGS. 2 and 3, particular details of the clip 10 of the initial embodiment of this invention are described in detail. The clip 10 of this particular embodiment can also alternatively be referred to as a cord holder or retainer and is adapted to both be fastened to the bottom rail B and provide a guide path adapted to support a portion of the lift cords C adjacent hereto. With the clip 10 of this initial embodiment, the fastener is in the form of a pair of fingers 20 extending up from the base plate 30. The fingers 20 are in the form of a front wall 22 preferably extending perpendicularly up from a front edge 32 of the base plate 30 and a rear wall 26 extending perpendicularly up from a rear edge 34 of the base plate 30. The front wall 22 and rear wall 26 are preferably parallel to each other and spaced apart similar to a depth of the bottom rail B of the window covering. Each wall 22, 26 preferably includes a tooth, such as the front tooth 24 or the rear tooth 28, extending toward each other from the walls 22, 26. These teeth 24, 28 extend sufficiently toward each other so that when the clip 10 is slid over the bottom rail B (along arrow E of FIG. 3), the teeth 24, 26 on the fingers 20 hold the clip 10 upon the bottom rail B. When the window covering is in the form of the shade S, one of the teeth (the front tooth 24 when shown as depicted in FIG. 3) would overlap a portion of the pleated shade S somewhat, and hold a portion of this pleated shade S directly adjacent a bottom rail B under the front tooth 24. In this embodiment, the clip 10 can be slid horizontally along the bottom rail B to any position desired for mounting of the clip 10.

The pair of fingers 20 provide one form of fastener or other means to couple the clip 10 to the lower portion of the window covering, such as the bottom rail B. In one form of this embodiment, the coupling means includes a pair of clamping surfaces, the clamping surfaces biased toward each other and adapted to grasp a portion of the window covering therebetween. The pair of clamping surfaces in this form of this embodiment includes a pair of fingers, each finger including a tooth at a tip thereof, the fingers extending up from a base plate, the fingers being spaced from each other by a distance similar to a depth of a bottom rail forming the lower portion of the window covering, the teeth on the fingers spaced from the base plate by a distance similar to a height of the bottom rail, such that the fingers and the base plate together grasp the bottom rail to hold the clip to the bottom rail.

Some form of guide path for the clip 10 is coupled to the clip 10 according to this initial embodiment. Most preferably, this guide path is in the form of an eyelet 50 located within the junction 40 extending down from a lower surface of the bottom plate 30. In particular, the junction 40 preferably includes a front curve 42 curving down and transitioning into a rear curve 44 extending back up to the base plate 30. These curves 42, 44 provide the junction 40 with sufficient depth so that the eyelet 50 can be formed through the junction 40.

The eyelet 50 preferably entirely surrounds a centerline aligned with central axis X (FIG. 2) and has the cords C routed therethrough. The eyelet 50 preferably includes a cylindrical wall 52 surrounding this central axis X, with the cylindrical wall 52 extending from an inlet 54 to an outlet 56. The cords C would be routed from the inlet 54 through to the outlet 56 and then on where the cord C extends vertically along the dangle axis Z (FIG. 2). While the eyelet 50 is the embodiment of guide path shown with the clip 10 of this initial embodiment, other guide paths of other different embodiments could be combined with the clip 10 of this initial embodiment. Similarly, each of the different fasteners disclosed in the different embodiments of clips disclosed herein could typically be substituted for other fasteners in each of these embodiments. Also, the various different guide paths of the different embodiments of the clips disclosed herein could be substituted for other alternative guide paths, so that additional embodiments could readily be constructed. While the eyelet 50 is shown completely surrounding the central axis X, it is conceivable that the eyelet 50 would have a slit formed therein, typically along a side of the eyelet 50, which would allow the cords C to be easily threaded into and out of the eyelet 50, without requiring removal of the dangles D, or sizing of the dangles D small enough to pass through the eyelet 50.

Figure 4:
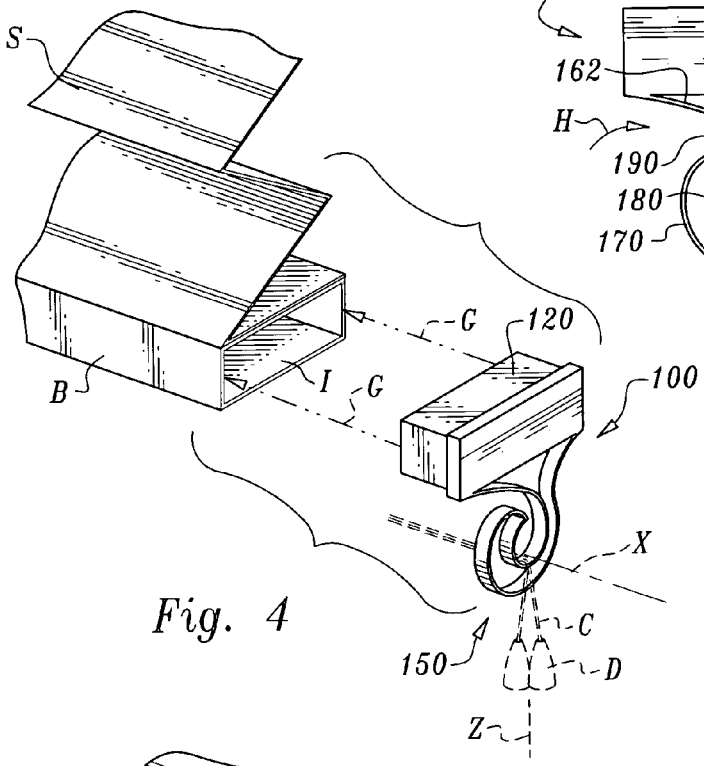
FIG. 4 is a perspective view similar to that which is shown in FIG. 3 but depicting a first alternative clip of this invention.
Figure 5:
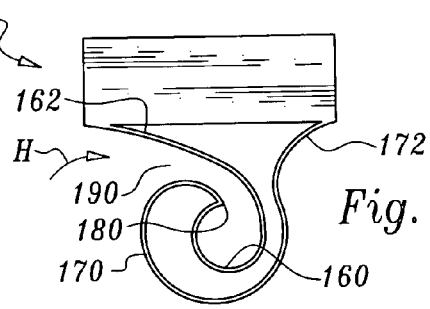
FIG. 5 is an end elevation view of the first alternative clip of FIG. 4.
Figure 6:
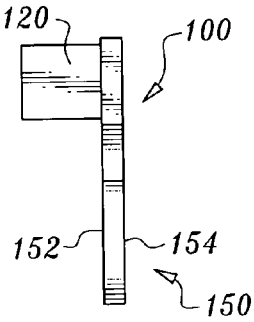
FIG. 6 is a front elevation view of that which is shown in FIG. 5.

With particular reference to FIGS. 4-6, details of a first alternative embodiment clip 100 are described. This first alternative clip 100 includes an insert 120 which acts as a form of nose which establishes one means to couple the clip 100 to a lower portion of the window covering. Other alternative coupling means are described with regard to the initial embodiment clip 10, and other alternative embodiments of the clip described in detail below. This first alternative clip 100 has the insert 120 preferably both sized and shaped to match a size and shape of an interior eye of the bottom rail B at an end thereof. Thus, the insert 120 can slide into this interior space I, such as along arrow G of FIG. 4, to fasten the first alternative clip 100 to the bottom rail B. Most preferably, the dimensions of the insert 120 are precisely controlled so that a slight friction fit exists and the insert 120 securely holds the first alternative clip adjacent to the bottom rail B.

With this first alternative clip 100, the guide path is preferably formed as a spiralet 150. The term spiralet is a coined term for a structure which is a combination of both an eyelet and a spiral. The spiralet 150 includes an inside curve 160 and an outside curve 170 which extend from mutual starts 162, 172 to a common tip 180. The inside curve start 162 is preferably at a front side of the spiralet 150 and the outside curve 170 is preferably configured to have the start 172 at a rear side of the spiralet 150. However, these two curves 160, 170 curve in a common direction and generally approach each other until they merge at the tip 180. A slit 190 is provided which provides access to an open central region of the spiralet 150 (such as along arrow H of FIG. 5). The curves 160, 170 are shown generally as French curves providing one form of spiralet 150. Alternatively, the spiralet could have curves which are not as smooth, but rather are faceted with various short straight sections joined together by angled sections and still generally have a form where two surfaces curve together around an open central space and come together at a tip leaving a slit 190 so that the cords C can access this central region of the spiralet 150. In this embodiment of the spiralet 150, the inside curve 160 curves approximately 360°. Alternatively, a greater or a lesser amount of curvature could be provided for the inside curve 160 of the spiralet 150 and the guide path provided would still be generally in the form of a spiralet.

The particular spiralet 150 shown in this embodiment is shown with the inside curve 160 and outside curve 170 thickened between an outside surface 152 and inside surface 154 so that a thickness is provided to the spiralet 150 and so that the central axis X along which the cords C are initially routed has a greater length within the spiralet 150. Alternatively, the spiralet 150 could be oriented entirely within a vertical plane, or could have a thickness which is maintained constant throughout the spiralet 150. While the spiralet 150 is shown with webbing between the inside curve 160 and outside curve 170, this webbing could be dispensed with so that space between the inside curve 160 and outside curve 170 could be hollow. Alternatively, this space between the inside curve 160 and outside curve 170 could be entirely filled with a thickness similar to that of the inside curve 160 and outside curve 170, rather than having a web of lesser thickness. The spiralet 150 beneficially allows the cords C to be readily passed into an interior region of the spiralet 150 (along arrow H of FIG. 5) through the slit 190. The cords C can also be readily removed from this interior space within the spiralet 150. However, accidental jostling of the cords C are discouraged from causing the cords C to come out of the spiralet 150, due to the particular orientation of the tip 180 and the degree of curvature of the inside curve 160 of the spiralet 150. The inside curve 160 and outside curve 170 would typically have a radius of curvature which decreases as these curves 160, 170 extend toward the tip 180, giving at least the inside curve 160 a general form of a spiral. This spiraling nature can be continuous, or can be disrupted various different ways, so that at least some form of general spiral is provided.

Figure 7:
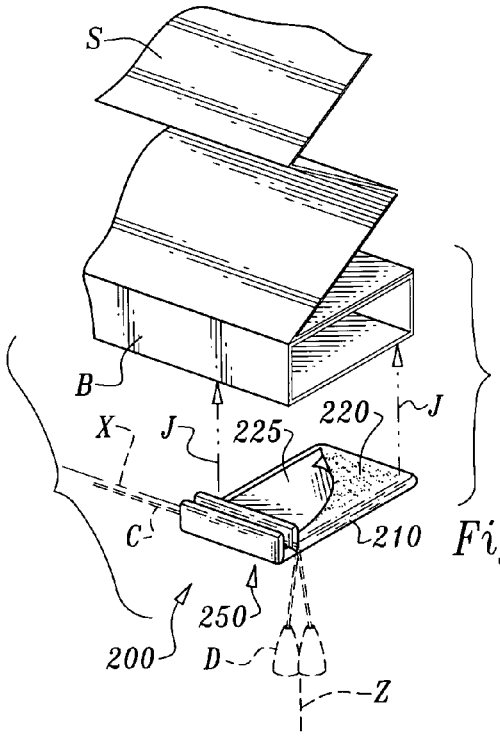
FIG. 7 is a perspective view similar to that which is shown in FIG. 3 but showing a second alternative clip of this invention.
Figure 8:
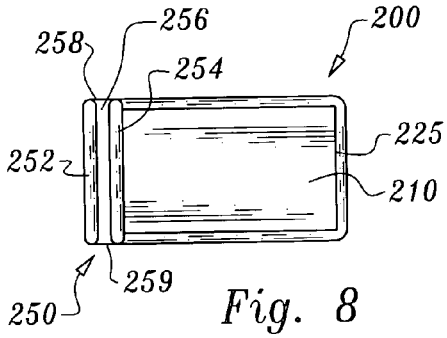
FIG. 8 is a top plan view of the second alternative clip of FIG. 7.
Figure 9:
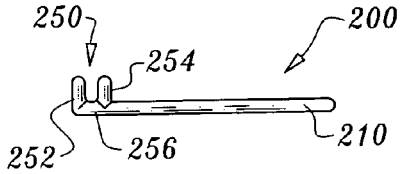
FIG. 9 is a side elevation view of that which is shown in FIG. 8.

With particular reference to FIGS. 7-9, details of a second alternative clip 200 are described. The second alternative clip 200 has the fastener thereof particularly configured as a platter 210 provided with an adhesive 220 to bond the platter 210 of the second alternative clip 200 directly to a lower surface of the bottom rail B. For instance, and as shown in FIG. 7, the adhesive 220 is provided with a cover 225 which can be removed to expose the adhesive 220. The platter 210 is then raised up into contact with the lower surface of the bottom rail B, such as along arrow J of FIG. 7, until the adhesive 220 comes into contact with the bottom rail B. The second alternative clip 200 is thus securely attached to the bottom rail B at a position where desired.

The guide path according to this second alternative clip is in the form of a slot 250. This slot 250 provides one form of trough through which the lift cords C can be routed and which would be oriented to surround the central axis X. This slot 250 particularly includes an outer fence 252 and inner fence 254 which are preferably substantially planar, parallel to each other and oriented vertically and perpendicular to the platter 210. These fences 254, 252 are preferably molded together with the platter 210 from a rigid mass of material.

A floor 256 defines a portion of a platter 210 between the outer surface 252 and inner surface 254 upon which the cords C would typically rest. The outer fence 252, inner fence 254 and floor 256 thus provide three sides of the guide path along which the cords C are routed when passing through the slot 250 of this second alternative embodiment 200. The slot 250 extends from an entrance 258 at which the cords C enter the slot 250 and an exit 259 at an end of the slot 250 where the cords C exit before turning and extending along the dangle axis Z vertically away from the exit 259.

Figure 10:
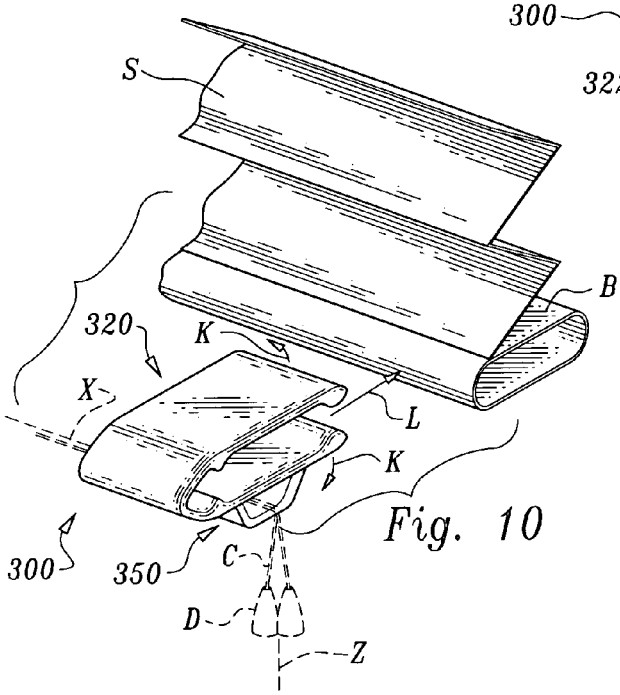
FIG. 10 is a perspective view of that which is shown in FIG. 3 but with a third alternative clip shown.
Figure 11:
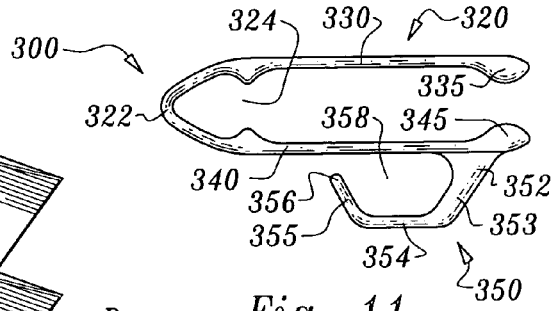
FIG. 11 is a side elevation view of a third alternative clip of FIG. 10.
Figure 12:
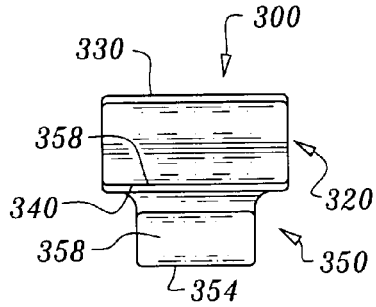
FIG. 12 is a front elevation view of that which is shown in FIG. 11.

With particular reference to FIGS. 10-12, particular details of a third alternative clip 300 are described. The third alternative clip 300 has the fastener thereof preferably provided in the form of a clamp 320. This clamp 320 generally includes a top plate 330 and bottom plate 340 which function together to form the clamp 320. The clamp 320 also includes a hinge 322 which joins the top plate 330 and bottom plate 340 together. This hinge 322 is biased so that the top plate 330 and bottom plate 340 prefer an orientation which is preferably slightly narrower than a width of a bottom rail B about which the clamp 320 is secured. Thus, this hinge 322 tends to hold securely to the bottom rail B. A neck 324 is provided adjacent the hinge 322 and between the top plate 330 and 340. This neck 324 provides a contour which matches a portion of a front edge of the bottom rail B to help secure the clamp 320 precisely where desired when snapped onto the bottom rail B.

The particular configuration of the bottom rail B can vary, as particularly shown in FIG. 10, with the clamp 320 or other form of fastener for the clip or other cord holder of this invention modified to match the particular contour of bottom rail B with which the clip or other cord holder is configured to be attached. A top plate 330 includes a top lip 335 extending downwardly from a tip thereof. The bottom plate 340 includes a bottom lip 345 extending upwardly from a tip thereof. These lips 335, 345 function similarly to the neck 324 to help position the top plate 330 and bottom 340 of the clamp 320 precisely where desired at a rear edge of the bottom rail B. Note that in the case of a pleated shade S, a portion of the shade S would typically be pinched between the top plate 330 and the bottom rail B by this clamp 320.

When the clamp 320 is to fasten the third alternative clip 300 to the bottom rail B, the third alternative clip 300 is initially moved laterally from a forward side of the bottom rail B into contact with the bottom rail B (along arrow L of FIG. 10). As the lips 335, 345 come into contact with the bottom rail B, the clamp 320 is opened by pivoting about the hinge 322. Once the third alternative clip 300 is then moved entirely onto the bottom rail B, the lips 335, 345 begin to pass beyond the bottom rail B and the plates 330, 340 of the clamp 320 close somewhat to secure the third alternative clip 300 to the bottom rail B.

With the third alternative clip 300, the guide path is preferably in the form of a hanger 350 formed with the clamp 320 and extending from a lower surface of the clamp 320. In particular, the hanger 350 extends from a lower surface of the bottom plate 340 of the clamp 320. This hanger 350 can have various different configurations, but in this embodiment, most preferably is configured as shown in FIG. 11. In particular, the hanger 350 includes a base 352 where the hanger 350 connects to the bottom plate 340. A down leg 353 extends downwardly, preferably somewhat at an angle from the base 352. An under leg 354 then preferably extends horizontally from the down leg 353. An up leg 355 then preferably extends upwardly and diagonally from the under leg 354 and away from the down leg 353. The up leg 355 stops at a tip 356 so that a space 358 above the under leg 354 and within the hanger 350 can be accessed, such as with the cords C, by routing over the tip 356 and below the bottom plate 340. The cords C can then be oriented through the hanger 350 as particularly shown in FIG. 10.

Figure 13:
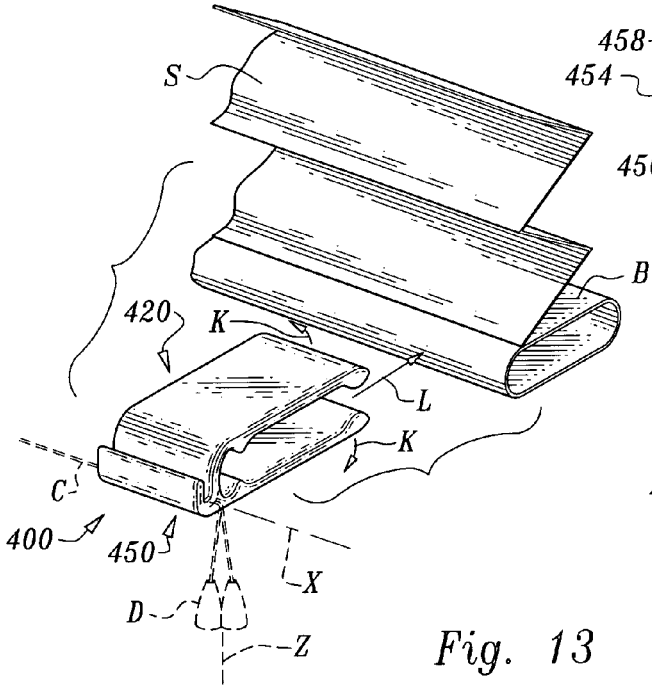
FIG. 13 is a perspective view similar to that which is shown in FIG. 3 but depicting a fourth alternative clip according to this invention.
Figure 14:
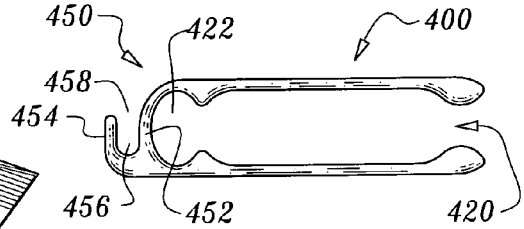
FIG. 14 is a side elevation view of the fourth alternative clip of FIG. 13.
Figure 15:
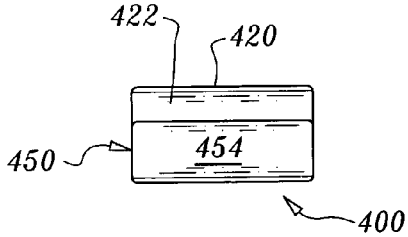
FIG. 15 is a front elevation view of that which is shown in FIG. 14.

With particular reference to FIGS. 13-15, details of a fourth alternative clip 400 are described. This fourth alternative clip 400 preferably provides a fastener in the form of an alternative clamp 420 generally very similar to the clamp 320 of the third alternative clip 300 (FIGS. 10-12). In particular, the alternative clamp 420 is similar to the clamp 320 except that the hinge of the alternative clamp 420 is in the form of the circular hinge 422 which has a slightly more circular form. The fourth alternative clip 400 has a guide path which is preferably in the form of a trough 450, as best shown in FIGS. 13 and 14. This trough 450 is generally similar to the slot 250 of the second alternative clip 200 (FIGS. 7-9).

In particular, the trough 450 includes an inner wall 452 and outer wall 454 which are preferably parallel to each other and oriented vertically. The inner wall 452 is preferably part of an outer surface of the circular hinge 422. A gap 456 is provided between the inner wall 452 and outer wall 454, along which the cord C can be routed when the cords C are extending generally along central axis X. An open top 458 of the trough 450 allows the cords C to be easily placed within the trough 450. Details of the attachment of this fourth alternative clip 400 are similar to those described with respect to the third alternative clip 300 (FIGS. 10-12). These fastening procedures are particularly shown in FIG. 13.

Figure 16:
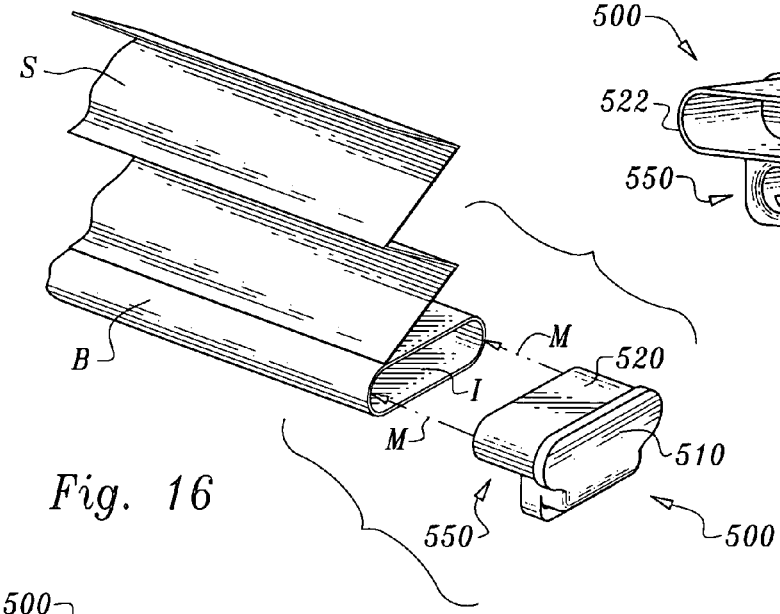
FIG. 16 is a perspective view similar to that which is shown in FIG. 3, but depicting a fifth alternative clip according to this invention.
Figure 17:
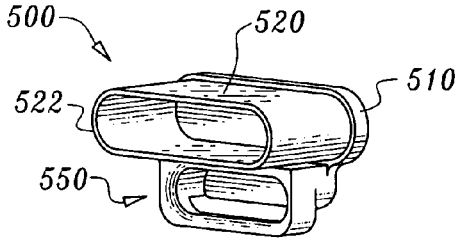
FIG. 17 is a perspective view of the fifth alternative clip of FIG. 16, shown alone and from a different perspective.
Figure 18:
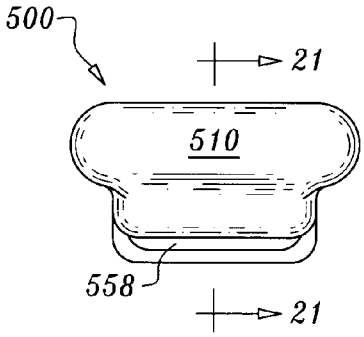
FIG. 18 is a right side elevation view of that which is shown in FIG. 17.
Figure 20:
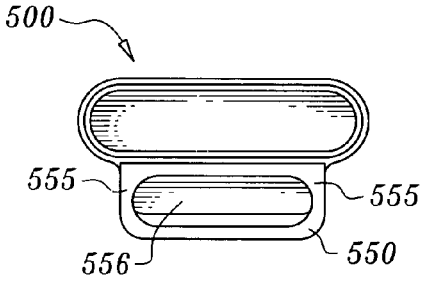
FIG. 20 is a left side elevation view of that which is shown in FIG. 17.
Figure 21:
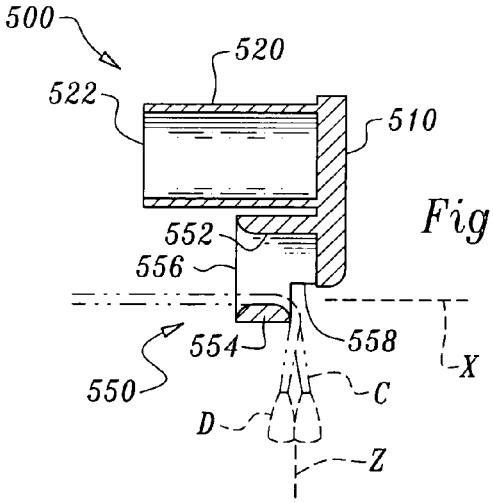
FIG. 21 is a front elevation view of that which is shown in FIG. 17, and shown in full section taken along line 21-21 of FIG. 18.
Figure 19:
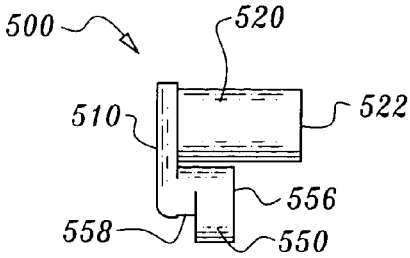
FIG. 19 is a rear elevation view of that which is shown in FIG. 17.

With particular reference to FIGS. 16-21, particular details of a fifth alternative clip 500 are described. This fifth alternative clip 500 includes an end cap 510 so that the fifth alternative clip 500 both acts as a retainer for the cords C, and also acts as a cap for an end of the bottom rail B, as is similar to the case with the first alternative clip 100 (FIGS. 4-6). The fastener of this fifth alternative clip 500 is preferably in the form of a nose 420 which is sized and shaped to fit within the interior eye of the bottom rail B. Note that this nose 520 is slightly differently shaped than the insert 120 of the first alternative clip 100 due to the fact that the bottom rail B has a slightly different form as depicted in FIG. 4 as with FIG. 16. The bottom rail B could in fact have a variety of different cross-sectional configurations with the form of the insert 120 or nose 520 preferably provided to match the cross-sectional contour of the interior eye and dimension to have a friction fit within this interior eye. The nose 520 is inserted within the interior eye by horizontal translation along arrow M (FIG. 16).

The guide path of this fifth alternative clip 500 is preferably provided in the form of a collar 550. The collar 550 functions similar to the eyelet 50 of the initial embodiment clip 10 (FIGS. 2 and 3) except that the opening through which the cords C pass has a slightly different size and shape. In particular, the collar 550 includes an upper wall 552 which acts as an upper portion of this hole through which the cords C can be routed. A lower wall 554 is provided generally parallel with and below the upper wall 552. The side walls 555 join the lower wall 554 to the upper wall 552. The collar 550 includes an entry 556 defined by portions of the upper wall 552, lower wall 554 and side walls 555 which extend the greatest distance toward a central portion of the bottom rail B (FIG. 16).

With this collar 550, a lower hole 558 is provided on a side of the lower wall 554 opposite the entry 556. The lower wall 554 is preferably of a shorter length than the upper wall 552 so that the cords C can pass down through the lower hole 558 and out of the collar 550 in a vertical direction along the dangle axis Z, and short of a vertical plane in which the end cap 510 is located, such that the end cap 510 can be directly adjacent the frame F of the window W (FIG. 1) and the cords C can extend down slightly spaced away from this frame F of the window W. Most preferably, edges of the upper wall 552, lower wall 554 and side walls 555 are curved on the collar 550 and also with other portions of the guide paths at the various different embodiments of this invention. This curving of such edges can help to minimize fraying of the cords C or other damage to the cords C, or binding of the cords C.

Most preferably, the degree of friction imparted on the cords C by the guide path of the various different embodiments of this invention is sufficiently low and the weight of the dangles D is preferably sufficiently high that the bottom rail B of the window covering can be raised and lowered along with the pushing of the button A of the cord brake without requiring that the user handle the cords C in any fashion. Alternatively, the user can hold the cords C with one hand while pushing the button A and moving the bottom rail B up or down. Such a procedure may be needed when friction through the cord brake is too high.

In particular, most preferably when the bottom rail B is to be lifted, the button A of the cord brake is depressed and the bottom rail B is lifted. The dangles D are sufficiently heavy that as this bottom rail B is lifted, the weight of the dangles D causes the cords C passing through the cord brake and out of the bottom rail B to remain substantially horizontal as they extend over to the clip 10 and then turn from the central axis X to the dangle axis Z before extending down to the dangle D.

Similarly, when the bottom rail B is to be lowered, the cord brake A is depressed and the bottom rail B is pulled downward. The cords C are fed through the cord brake and the dangles D move upwards towards the clip without requiring any handling of the cords C.

In some embodiments of this invention, it may be necessary to remove the cords C from the clip when the bottom rail B is to be lowered all the way down to a bottom of the frame F surrounding the window W. In such a configuration, only a short portion of the cords C remain and the cords C are not sufficiently long to make it all the way to a position of the clip 10 if this position is at an extreme edge of the shade S. Most preferably, the various different guide paths are configured so that the cords C can be readily removed from the guide path when such positioning of the bottom rail B at a very lowermost portion is desired. The cords C are merely removed from the guide path so that it now extends down from the cord brake in the bottom rail B. The bottom rail B can then be adjusted in position with depression of the button A on the cord brake until the bottom rail B is precisely where desired, with the cords C optionally remaining out of the clip 10. However, in this configuration, only a short portion of the cords C extend out of the bottom rail B and the window W is substantially entirely blocked so that the centralized position of the cords C has no effect on the view through the window W.

When the bottom rail B is to again be raised, after the bottom rail B has been lifted to a desired location along with depression of the button A for release of the cords C, the cords C can be again routed through the guide path of the clip 10 so that the cords C again remain in a most preferred position not blocking a view through the window W (FIG. 1) and decreasing an amount of cords C extending vertically down from the bottom rail B, for maximum distance away from children.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A window covering adapted to be suspended adjacent a window, the window covering comprising in combination:

a shade portion extending from a top rail to a bottom rail;

said top rail adapted to be attached to a structure adjacent a window;

said bottom rail adapted to move up toward said top rail and down away from said top rail;

said window covering including at least one cord extending between said top rail and said bottom rail;

at least a portion of said cord extending below said bottom rail and dangling freely below said bottom rail;

a clip adapted to support a portion of said cord where said cord extends below said bottom rail;

said clip including a means to couple said clip to said bottom rail; and a guide path adapted to support a portion of said cord when said cord is located adjacent said guide path support means;

wherein said clip has a length less than a length of said bottom rail, said lengths being oriented along a longitudinal axis of said bottom rail, said clip slidably coupled to said bottom rail for variable positioning of said clip to said bottom rail at various different positions along said bottom rail;

wherein said guide path includes a substantially complete hole adapted to have said cord of the window covering routed therethrough;

a slit extending into said hole from a side thereof;

said slit adapted to allow said cords to pass into said hole;

wherein said at least one cord dangles from said bottom rail at substantially a middle of said bottom rail between ends of said bottom rail, said clip coupled to said bottom rail between said middle of said bottom rail and one of said ends of said bottom rail;

wherein said coupling means includes a pair of clamping surfaces, said clamping surfaces biased toward each other and adapted to grasp a portion of the window covering therebetween;

wherein said pair of clamping surfaces includes a pair of fingers, each finger including a tooth at a tip thereof, said fingers extending up from a base plate, said fingers being spaced from each other by a distance similar to a depth of said bottom rail, said teeth on said fingers spaced from said base plate by a distance similar to a height of said bottom rail, such that said fingers and said base plate together grasp said bottom rail to hold said clip to said bottom rail; and wherein each finger is substantially planar and said base plate is substantially planar and said fingers extend from opposite edges of said base plate substantially perpendicular to said base plate.

* * * * *